United States Patent [19]

Lahr

[11] Patent Number: 4,747,715

[45] Date of Patent: May 31, 1988

[54] VACUUM BUFFERED RIBBON TRANSPORT SYSTEM

[75] Inventor: Roy J. Lahr, Los Angeles, Calif.

[73] Assignee: Creative Associates, Los Angeles, Calif.

[21] Appl. No.: 4,748

[22] Filed: Jan. 8, 1987

Related U.S. Application Data

[63] Continuation of Ser. No. 794,961, Nov. 4, 1985, abandoned, which is a continuation of Ser. No. 570,913, Jan. 16, 1984, abandoned.

[51] Int. Cl.[4] ..... B41J 35/08; B41J 33/34

[52] U.S. Cl. ..... 400/248.3; 400/212; 400/215; 400/216; 400/216.2; 400/225; 400/229; 400/234; 400/247; 226/95; 242/147 A; 242/182

[58] Field of Search ..... 400/211, 212, 213, 213.1, 400/215, 216, 216.1, 216.2, 217, 229, 226, 185, 187, 320, 197, 199, 202, 202.4, 223, 224, 225, 234, 246, 247, 248, 248.1, 248.2, 248.3, 250; 226/93, 95; 242/147 A, 157 R, 157.1, 182, 183, 184, 185

[56] References Cited

U.S. PATENT DOCUMENTS

| | | | |
|---|---|---|---|
| 2,614,676 | 10/1952 | Pessoa | 400/248 |
| 2,848,090 | 8/1958 | Sharpe et al. | 400/215 |
| 2,972,402 | 2/1961 | Howard | 400/225 |
| 2,973,082 | 2/1961 | Newman et al. | 400/248.3 |
| 3,084,881 | 4/1963 | Wolf | 400/234 |
| 3,185,400 | 5/1965 | Maxey | 242/183 |
| 3,353,732 | 11/1967 | Reader | 242/182 |
| 3,613,857 | 10/1971 | Thevis | 400/226 |
| 3,625,334 | 12/1971 | Ahn | 400/198 |
| 3,878,979 | 4/1975 | Cristiani | 242/182 |
| 3,958,777 | 5/1976 | Gervais et al. | 242/182 |
| 3,967,790 | 7/1976 | Hess | 242/75.5 |
| 3,998,313 | 12/1976 | Hickey | 400/234 |
| 4,000,804 | 1/1977 | Zaltieri | 400/225 |
| 4,053,040 | 10/1977 | McGourty | 400/235.1 |

FOREIGN PATENT DOCUMENTS

| | | | |
|---|---|---|---|
| 35771 | 9/1981 | European Pat. Off. | 400/234 |

OTHER PUBLICATIONS

"Peripheral Printer Ribbon Drive Mechanism"; Firth et al.; *IBM Technical Disclosure Bulletin;* vol. 22, No. 3, p. 875; Aug. 1979.

*Primary Examiner*—David Wiecking
*Attorney, Agent, or Firm*—Kenyon & Kenyon

[57] ABSTRACT

A printer having extended ribbon capacity is provided with a vacuum buffering system which stores ribbon on either side of a ribbon utilization mechanism, illustratively an impact print head. In a preferred embodiment, the ribbon is stored in a pair of vacuum chambers which are arranged to pivot about a common axis as a carriage which bears the print head is translated along a carriage path. The vacuum chambers are each provided with telescopically extendable members which compensate for variations in the distance between the pivot of the vacuum chambers and the print carriage, as the print carriage is translated. A ribbon lift system for multitrack embodiments utilizes off-carriage drive and a direction-determining clutch toggle system.

6 Claims, 12 Drawing Sheets

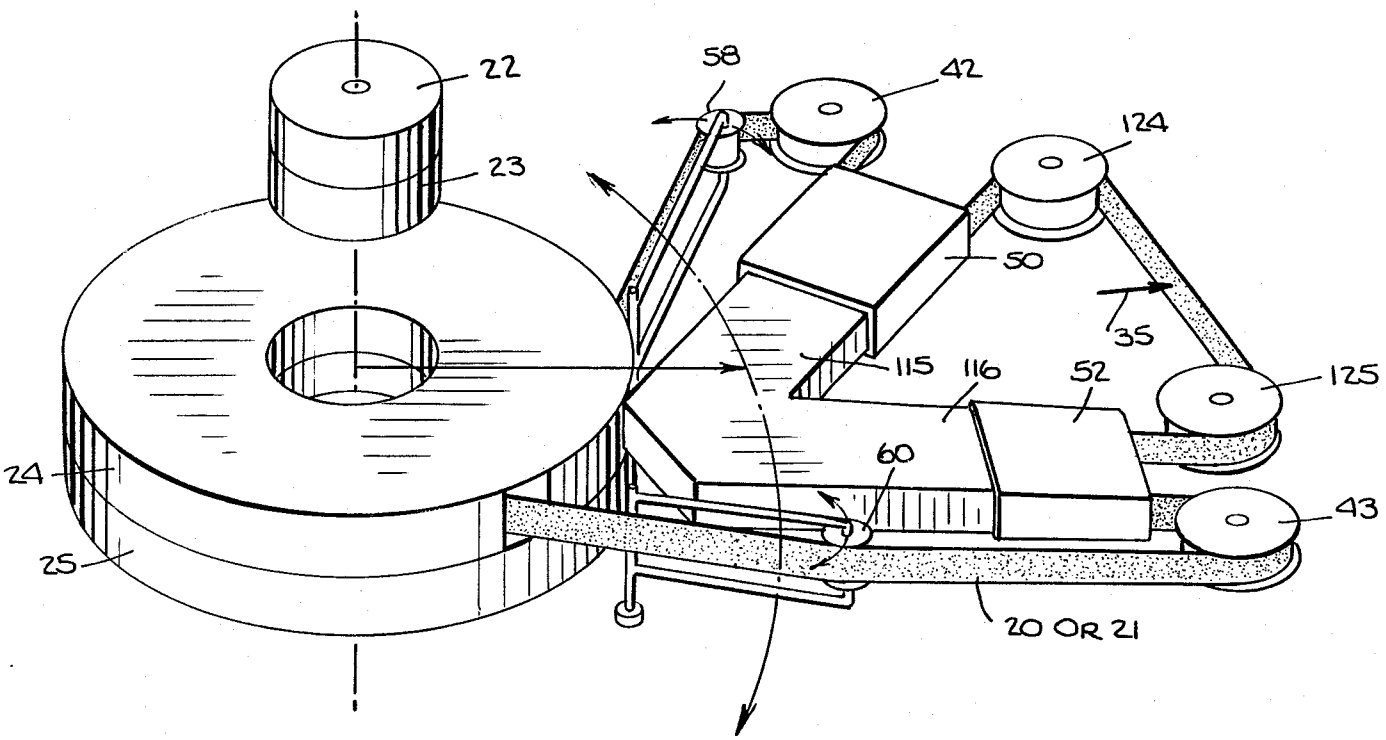
Fig 9.B.

VACUUM BUFFERED RIBBON TRANSPORT SYSTEM

This application is a continuation of application Ser. No. 794,961, filed Nov. 4, 1985, now abandoned, which is a continuation of Ser. No. 570,913 filed Jan. 16, 1984, now abandoned.

BACKGROUND OF THE INVENTION

This invention relates generally to transport systems for ribbons, tapes, and web structures, and more particularly, to a transport system which supplies a ribbon-like structure to a movable utilization head.

The rapid acceleration and deceleration of tapes or other ribbon-like structures has been a problem in the design and operation of various types of electromechanical equipment. One type of equipment which has long been plagued by engineering problems associated with pulsed ribbon usage is in the field of tape recording devices, particularly of the type which store and supply data for use by electronic computers. Such devices are generally required to transmit data to an electronic computer, and receive data to be recorded, while the tape or ribbon is transported across the magnetic heads at greater than a predetermined minimum speed. Such a speed requirement produces waste of the tape because no data recording or transmission can be performed during the time that the tape is being accelerated to the predetermined minimum speed. Moreover, since such devices cannot stop the tape instantaneously, the length of tape which is transported by the heads while the tape is decelerating to a stop is also wasted.

The prior art has provided arrangements for reducing the acceleration and deceleration times of tape. In a known system, the tape is drawn by a vacuum into a storage chamber where a predetermined length of the tape is stored. In operation, the tape is moved through the vacuum chamber to meet the demands of utilization at the tape heads. However, a predeterminable length of the tape is maintained in the vacuum chamber so as to form a buffer between a ribbon reel and the utilization head. Thus, when the tape which is transported across the heads is desired to be accelerated or decelerated quickly, the tape reels, which are substantial inertial masses, need not be stopped and started with equal acceleration. Thus, acceleration and deceleration can be achieved in a much shorter time, resulting in a substantially reduced waste of the tape.

In some known tape recording arrangements, the tape is stored in vacuum chambers on either side of the utilization head. By this provision, the system is made bidirectional such that the tape can be transported past the tape head in either direction.

Many of the problems discussed hereinabove are applicable to printers. However, printers have different operating characteristics from tape recording machines, many of which raise problems which are not solved by the aforementioned known vacuum buffering systems. A first major problem-raising difference between printers and tape recording machines is that the printing carriage of a printer is moved along a fairly long printing path during operation. Clearly, it is more difficult to supply a ribbon to a moving printing carriage than to a stationary magnetic head. For this reason, almost all commercially successful serial impact printers have approximated the situation of a tape recording machine by installing the ribbon supply and take-up reels directly onto the carriage. It is a problem with such known moving ribbon reel arrangements that as the printing carriage is moved to each subsequent printing location, and stopped thereat so that the printing head on the carriage can perform the printing function, the overall mass of the arrangement, including the ribbon reels, which must be stopped and started at each print location, is a limiting factor in achieving high printer speed.

A further distinction between a printer and a tape recording machine is that a printer utilizes its ribbon while the ribbon is stopped. Moreover, each utilization of the ribbon, at each printing location, consumes the ink on the ribbon thereby requiring a fresh section of ribbon to be interposed between the printing element and the paper to be printed for each printing operation. There is, therefore, no alternative in a printer but to stop and start the ribbon, unlike the situation of the tape recording machine where the tape could be run continuously if waste could be tolerated. There is, therefore, a pressing need for a ribbon supply arrangement for a printer which can rapidly accelerate and decelerate the ribbon.

As the rate of operation of printers is advantageously increased, it is intuitively obvious that the rate at which the ribbon is transported and consumed is also increased. There is therefore a need for supplying printers with greater amounts of ribbon so as to increase the duration of the time interval between ribbon changes. Such greater amounts of ribbon, however, cannot be supplied without increasing the overall mass of the ribbon supplied in the printer. In the known printers, the increased ribbon mass renders the required stopping and starting of the carriage more difficult. Moreover, the starting and stopping of the ribbon to provide fresh ribbon for each subsequent printing function is also rendered more difficult in view of the increased mass and momemnt of inertia of the enlarged ribbon reels.

In addition to the foregoing, ribbons of the type used in printers are entirely distinguishable from magnetic recording types insofar as they are provided with a frangible ink coating on one side which is easily broken and removed. Thus, unlike magnetic tape which can be handled firmly on either side, such as by interposing it between a capstan and a pinch roller, such treatment of a printing ribbon would result in at least partial removal of the ink coating, causing ink particles to be distributed within the machine. Of course, print quality is also degraded when a ribbon which is only partially coated with ink is used.

It is still a further distinction between tape recording machines and printers that printers mechanically deform the ribbon during usage. The application of an impact force, illustratively in the shape of a fully-formed character, causes a physical deformation of the ribbon. Such a deformation has the effect of increasing the effective thickness of the ribbon, thereby creating difficulty in taking-up the used ribbon on a reel having the same diameter as the supply reel. The take-up reel tends to fill to capacity before the supply reel is exhausted of ribbon.

It is, therefore, an object of this invention to provide a ribbon transport arrangement which can be provided with a larger supply of ribbon than known arrangements without adding undue mass to a printing carriage which is moved discontinuously.

It is a further object of this invention to provide a ribbon transport arrangement which is supplied with a greater amount of ribbon than known arrangements, but which reduces the effect of ribbon and its supporting structure upon the printing carriage.

It is also an object of this invention to provide a ribbon transport arrangement which can accelerate and decelerate a film or fabric ribbon in less time than known ribbon transport arrangements used in printers.

It is still a further object of this invention to provide a ribbon transport arrangement which can accommodate for deformities in the ribbon resulting from impact printing.

It is still another object of this invention to provide a ribbon transport system for transporting a ribbon of the type which is coated on one side with a printing ink; the ribbon transport system communicating with the ribbon only via the reverse, uncoated side thereof.

SUMMARY OF THE INVENTION

The foregoing and other objects are achieved by this invention which provides a ribbon transport arrangement of the type which transports a ribbon between first and second ribbon reels. In a printer embodiment, a printing carriage which contains a printing element is translated along a predetermined printing path. A movable vacuum storage arrangement or vacuum storage chamber means stores a predeterminable length of the ribbon, the ribbon storage arrangement being moved in correspondence with the translation of the printing carriage along the predetermined printing path. The first and second ribbon reels are rotatably mounted off of the printing carriage. It is to be understood that although the ribbon is indicated herein as being stored on "reels," the present invention is premised at least partially on the understanding that "reels" may encompass other known ribbon storage systems such as festoon zones. For the sake of simplicity, however, the invention will be disclosed in the context of reels.

In a preferred embodiment of the invention, the vacuum storage arrangement or vacuum storage chamber means is provided with first and second vacuum chambers for storing predetermined portions of the ribbon. The first vacuum chamber stores ribbon which is transported between the first ribbon reel and the printing carriage, and the second vacuum chamber stores ribbon which is being transported between the second ribbon reel and the printing carriage. Each of the vacuum chambers is provided with a pneumatic pressure whichis lower than atmospheric air pressure so as to draw the ribbon into itself. However, mechanism may be provided for introducing the ribbon initially into the vacuum chambers. It is a significant feature of the present invention that a system is provided whereby ribbon is handled on only one side. Thus, the ink side of the ribbon need not be touched by the equipment, except upon printing.

The vacuum column storage of ribbon permits much higher accelerations of ribbon advance with a given torque motor or stepper, or alternatively, the use of a much smaller rotary power unit. Alternative embodiments of single motor, off-carriage drive for the tape motion are provided in addition to the use of several small on-board motors in another embodiment.

The vacuum storage arrangement is moved so that an axis thereof remains directed essentially to the printing carriage. In a particularly advantageous embodiment, a drive system which drives the printing carriage along the predetermined printing path also drives the vacuum storage system. The vacuum storage system is preferably moved so as to rotate about a pivot point which is located at a fixed location with respect to the predetermined printing path. Of course, further drives may be provided to move the vacuum storage system in accordance with nonpivotal motion, but such pivotal motion is preferred because of its mechanical simplicity and economy.

In a pivoting embodiment of the invention, the vacuum storage arrangement is provided with a first portion which is maintained at a substantially constant distance from the pivot point. The arrangement is further provided with a second portion which has an access opening therein to facilitate passage therethrough of the ribbon. This second portion, and particularly the access opening, is arranged at a distance which varies from the pivot point in correspondence with the translation of the printing carriage. Thus, in an embodiment where the pivot point is disposed so that its shortest distance from the predetermined printing path is measured near the center of the printing path, translation of the printing carriage along the predetermined printing path will cause angular displacement of the vacuum storage arrangement with respect to the predetermined printing path. Simultaneously, the distance from the access opening of the second portion to the pivot point increases as the printing carriage is moved in either direction away from the center of the predetermined printing path. Each of the vacuum chambers is provided with corresponding first and second portions, and a seal may be interposed between the respective first and second portions to prevent loss of vacuum.

BRIEF DESCRIPTION OF THE DRAWINGS

Comprehension of the invention is facilitated by reading the following detailed description in conjunction with the annexed drawings, in which:

FIG. 9B is a diagrammatic isometric representation of a multilevel, coaxial, and pivotable mounting for the supply and take-up reels;

DETAILED DESCRIPTION

Figure 1:
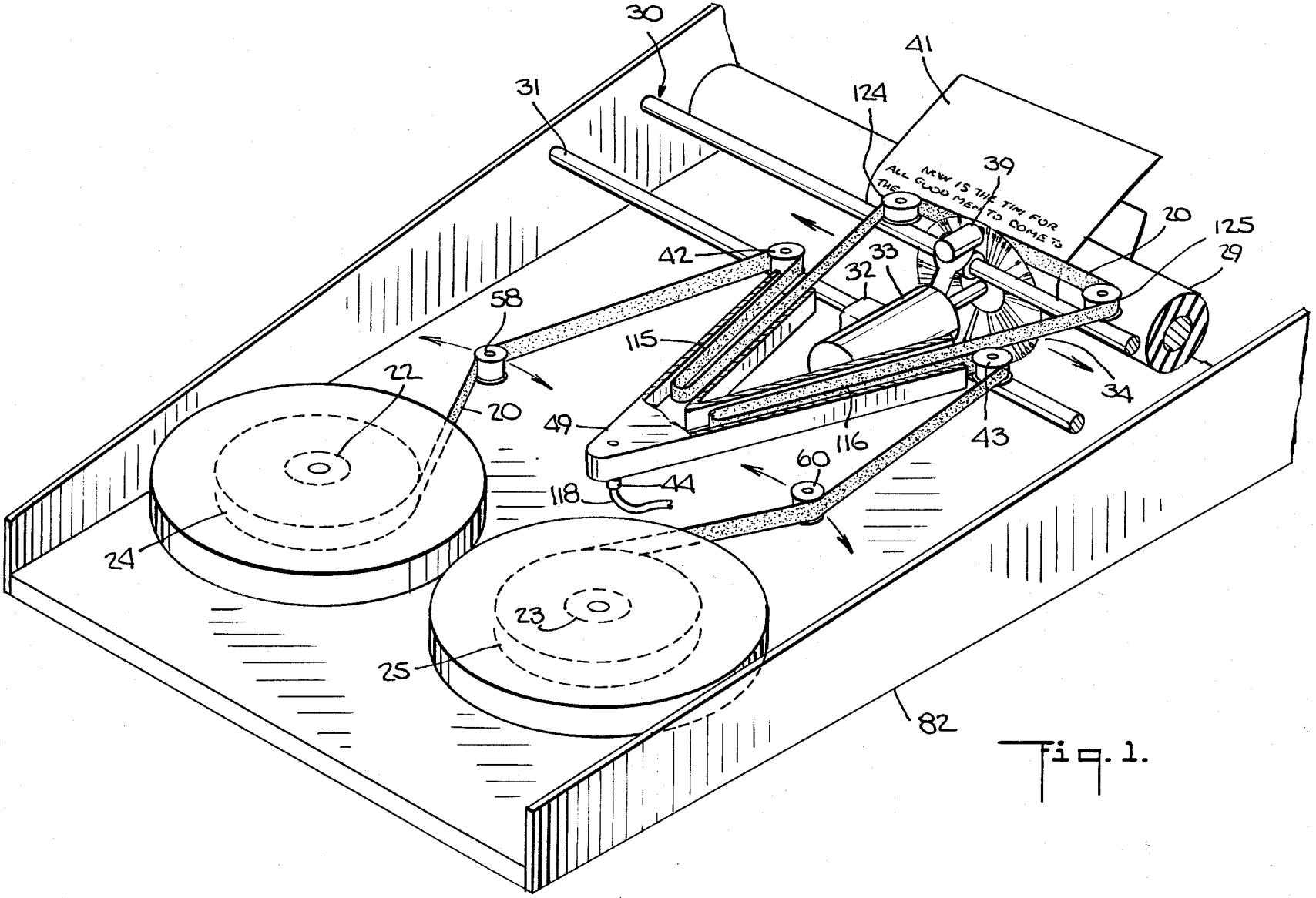
FIG. 1 is an isometric representation of a vacuum-buffered ribbon drive constructed in accordance with the invention.

FIG. 1 is an isometric representation of a printer arrangement having a vacuum buffered ribbon supply system constructed in accordance with the invention. As shown, the printer arrangement is provided with a left ribbon reel 24 and right ribbon reel 25, either of which can operate as a supply reel or a take-up reel. As indicated, one or both such reels may be replaced by a festoon arrangement. For purposes of discussion, a ribbon 20 is viewed as running from left ribbon reel 24, acting as a supply reel, past a left dancer idle pulley 58, and onto a left buffer control hub 42. Left dancer idler pulley 58 is movable in a circular path which is centered roughly on left reel drive hub 22, and senses the tension in the portion of ribbon 20 between left ribbon reel 24 and left buffer control hub 42. In addition the position of left dancer idler pulley 58 controls the motion of left reel drive hub 22. When ribbon 20 is taut, left reel drive hub 22 rotates in a counterclockwise direction to permit more of ribbon 20 on reel, thereby lessening the tension. When tension in ribbon 20 is moderate, left reel drive hub 22 stops rotating. The print carriage, which includes impact hammer 39, is mounted via supports, e.g., 32, for translation on cross-shafts 30, 31.

Ribbon 20 passes from the region near left dancer idler pulley 58, around left buffer control hub 42, and then into a left vacuum column 115. Left buffer control hub 42 has a vacuum gripper surface and rotates to draw ribbon 20 from left ribbon reel 24 so as to keep left vacuum column 115 filled with a loop of ribbon 20.

In this embodiment, low pressure vacuum is supplied to a main vacuum buffer case 49 through a vacuum inlet 118 and then through a hollow main buffer case pivot 44. Such a vacuum is present in left vacuum column 115 and in a right vacuum column 116, thereby drawing ribbon 20 into a loop therein. The amount of ribbon 20 available for a loop determines the position of the loop within vacuum column 115. A left vacuum column sensor (not shown in this figure) monitors the loop depth within the vacuum chamber and rotates left buffer control hub 42 so as to keep left vacuum column 115 filled with ribbon 20 to approximately $\frac{7}{8}$ of its column length. When a sufficient amount of ribbon is present within left vacuum column 115, buffer control hub 42 will stop rotating. It should be noted that when left buffer fill hub 42 rotates so as to place ribbon 20 into the loop within left vacuum column 115, this tends to draw ribbon 20 taut, thereby causing dancer idler pulley 58 to move rightward arcuately. Such a rightward motion tends to release left reel drive hub 22 so that a left ribbon reel 24 will supply more ribbon 20 thereby relieving the tension in the ribbon in the region of left dancer idler pulley 58. The vacuum buffer arrangement of the embodiment described herein is therefore symmetrical.

The vacuum gripping action of left buffer control hub 42, which is applied on the uncoated side of ribbon 20, is sufficiently strong so that even if left reel drive hub 22 rotates in a direction which takes up ribbon 20, left dancer idler pulley 58 will be urged rightwardly, but ribbon 20 will not slip on the surface of left buffer control hub 42.

Ribbon 20 exits left vacuum column 115 towards and around a left print drive hub 124. The path of the ribbon then continues laterally in front of a print disc 34 to a right print drive hub 125. Accordingly, a ribbon utilization path is provided between left print drive hub 124 and right print drive hub 125 adjacent paper 41 support platen 29. Both left print drive hub 124 and right print drive hub 155 grip ribbon 20 tightly by a suction force which is applied to apertures (not shown) on the hub surfaces. Ribbon 20 is maintained taut between left print drive hub 124 and right print drive hub 125 by mechanism (not shown) which causes the print drive hub on the take-up side of the printer to lead slightly. Thus, in this example where ribbon 20 is moved in a direction such that right ribbon reel 25 performs as the take-up reel, right print drive hub 125 rotationally leads left print drive hub 124 by a small amount. After passing around right print drive hub 125, ribbon 20 enters a right vacuum column 116 and forms a loop therewithin.

Upon exiting from right vacuum column 116, ribbon 20 passes around a right buffer control hub 43. Right buffer control hub 43 utilizes a vacuum grip on its periphery so as to grip ribbon 20 firmly from its uninked side. The rotation of right buffer control hub 43 is controlled by a right vacuum column sensor (not shown in this figure) which monitors the extent of the loop of ribbon 20 within right vacuum column 116 so that a maximum depth of about $\frac{7}{8}$ of the overall column length is maintained for the ribbon loop. At this $\frac{7}{8}$ depth, right buffer control hub 43 will rotate, thereby removing ribbon 20 from right vacuum column 116. The emergence of ribbon 20 from right vacuum column 116 will cause a slack in the length of ribbon between right buffer control hub 43 and right ribbon reel 25. A spring-loaded right dancer idler pulley 60 presses against the uncoated side of ribbon 20, and when excess ribbon 20 is present, the rightward motion of right dancer idler pulley 60, which moves in an arcuate motion about approximately the center of right reel drive hub 23, will cause right reel drive hub 23 to rotate. Such rotation of right reel drive hub 23 causes excess ribbon 20 to be taken up until right dancer idler pulley 60 is urged leftwardly as ribbon 20 becomes taut. Such leftward movement of right dancer idler pulley 20 causes right reel drive hub 23 to stop rotating. In this example, ribbon 20 moves in a direction such that right ribbon reel 25 performs as a storage take-up reel.

Figures 2A, 2B:
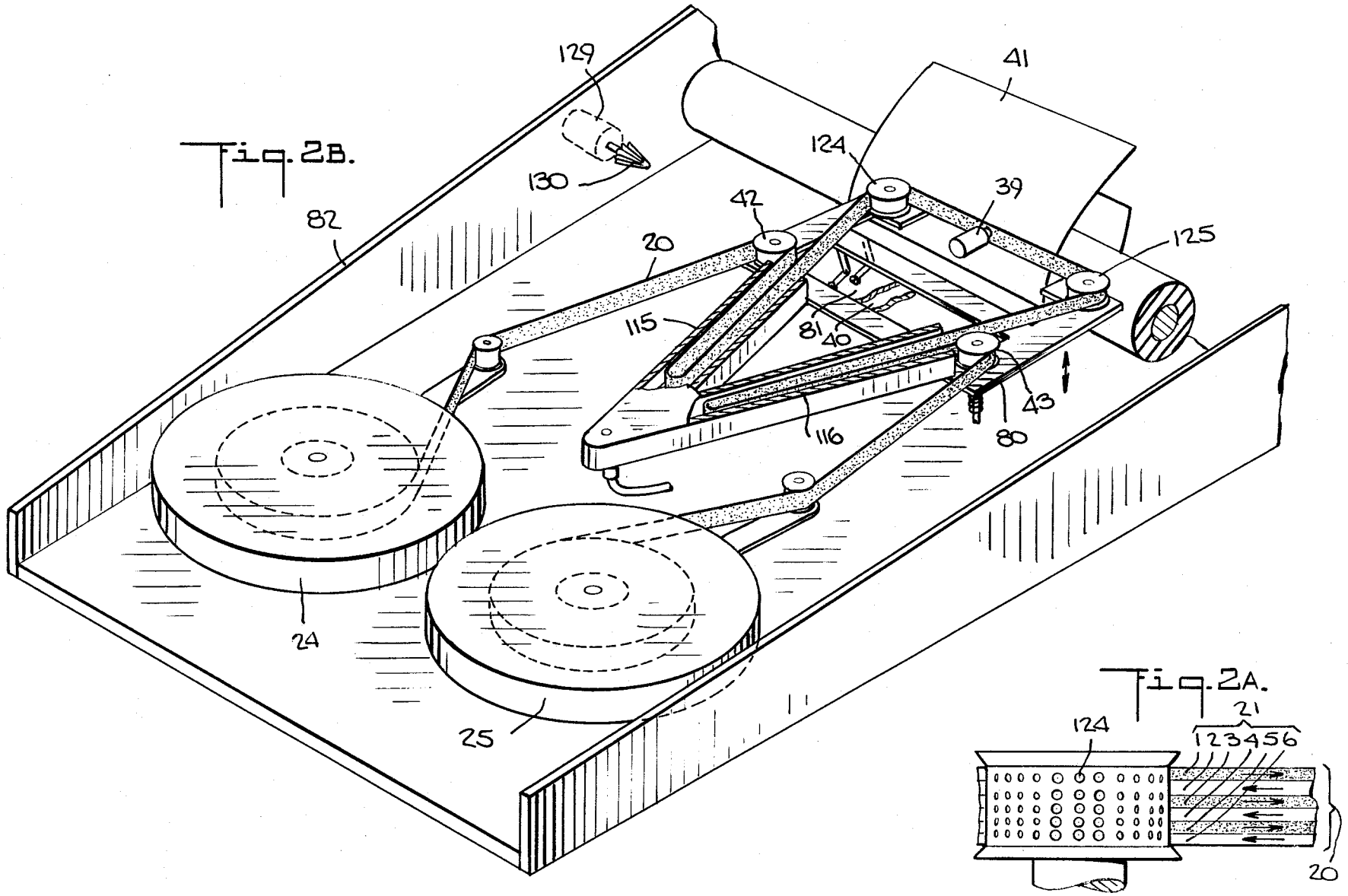
FIGS. 2A and 2B illustrate additional details of the embodiment of FIG. 1.

FIG. 2A is an enlarged detailed view of ribbon 20 and left print drive hub 124. As shown, ribbon 20 is sufficiently wide to accommodate up to six ribbon strike bands 21. In this specific illustrative embodiment of the invention, each ribbon strike band 21 is used for printing by print disc 34 for the entire length of ribbon 20. When the end of ribbon 20 has been reached, the particular strike band in use is exhausted and a ribbon system lift frame 80, which is shown in FIG. 2B, is repositioned such that a different ribbon strike band 21 on ribbon 20 is in the printing position, and the direction of motion of ribbon 20 is reversed. Such reversal causes right ribbon reel 25 to perform as a supply reel, and left ribbon reel 24 to perform as a storage take-up reel. After each such reversal of the direction of movement of the ribbon printing occurs on a different ribbon strike band 21 such that ribbon 20 need not be replaced until all ribbon strike bands 21 have been utilized. The order in which ribbon strike bands 21 are utilized can be advantageously selected to reduce the adverse effects of embossing the ribbon during printing. For example, as shown in FIG. 2A, ribbon strike bands 21 are numbered sequentially 1–6 from the uppermost to the lowermost such ribbon strike band. One advantageous sequence of ribbon strike band utilization may begin with the third strike band and continue with the fourth, fifth, second, sixth, and first strike bands, in alternating directions of ribbon travel shown by the arrows.

In FIG. 2B, a ribbon lift motor 129 is installed on the leftmost side of printer frame 82. When a print carriage 40 moves to the leftmost position, carrying a ribbon system reference frame 81 mounted thereabove, a ribbon lift female spline (shown in FIG. 3) is positioned to engage a ribbon lift motor male spline 130 which is affixed to the shaft of ribbon lift motor 129, as will be described hereinbelow with respect to FIG. 3, the rotation of ribbon lift motor 129, while print carriage 40 is in its leftmost position, will cause shifting between ribbon strike bands 21 on ribbon 20.

Figures 3A, 3B:
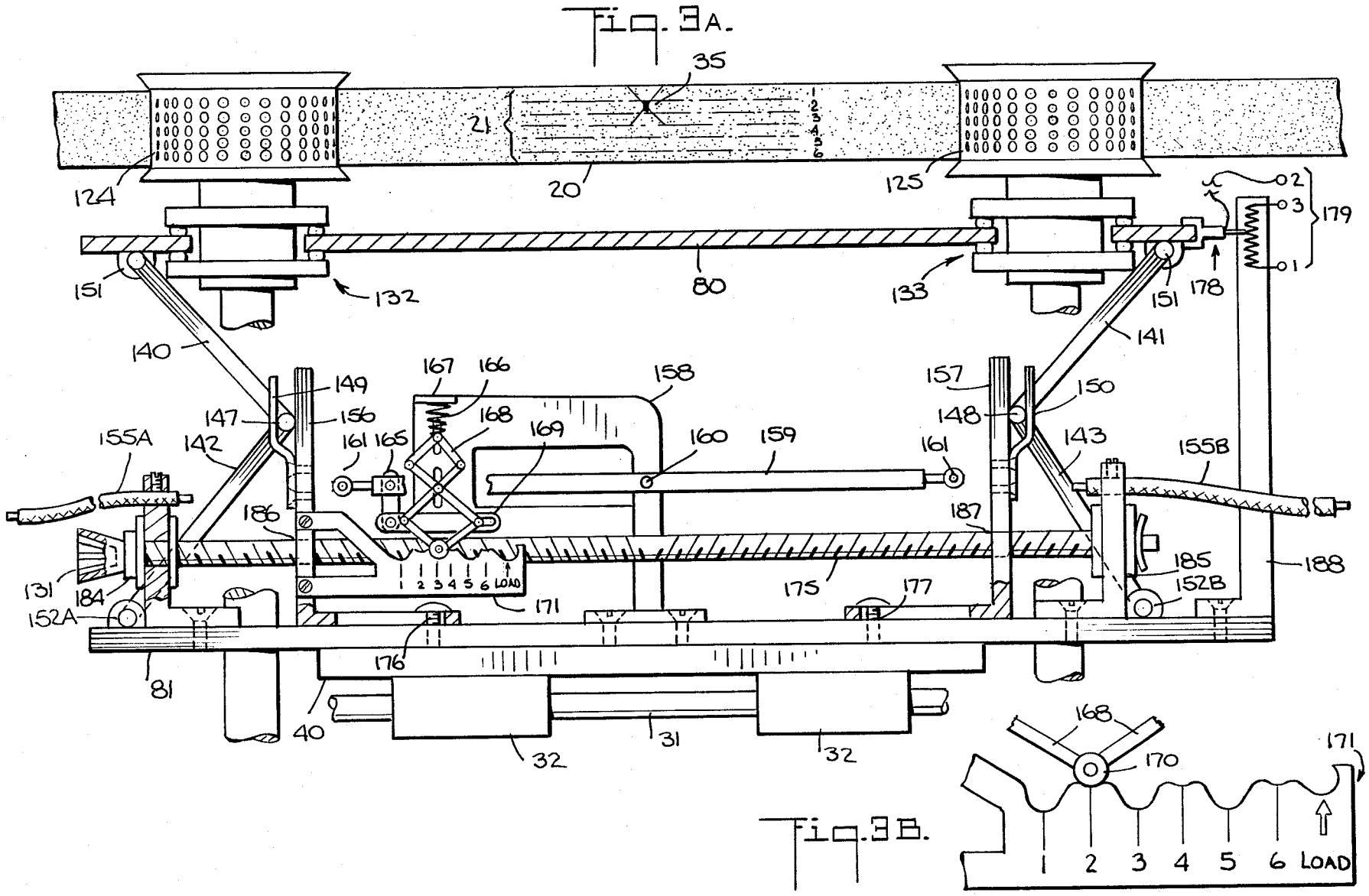
FIGS. 3A and 3B illustrate the structure and operation of a ribbon lift system constructed in accordance with the invention for selecting printing tracks on a ribbon.

FIGS. 3A and 3B are simplified, partially cross-sectional, rearward plan views of a ribbon lift system which is suitable for selecting different ones of ribbon strike bands 21 and a programmer cam card 171, respectively. Ribbon system lift frame 80 supports a left print clutch assembly 132 with left print drive hub 124 thereabove. In addition, a right print clutch assembly 133 with right print drive hub 125 thereabove is also provided. Ribbon 20 is shown extending across the left and right print drive hubs with its six ribbon strike bands 21.

In FIG. 3A, ribbon system lift frame 80 is positioned at a vertical height in this example such that ribbon strike band 21 number 2 registers with a print point 35. In operation, ribbon system lift frame 80 is raised and lowered vertically, and maintained parallel to ribbon system reference plane 81 by a pantograph assembly comprised of a pair of left upper pantograph arms 140, a pair of right upper pantograph arms 141, a pair of left lower pantograph arms 142, and a pair of right lower pantograph arms 143.

Right and left upper pantograph arms 140 and 141 are pivotally mounted to ribbon system lift frame 80 by a set of upper pantograph pivots 151, and right and left lower pantograph arms 142 and 143 are pivotally coupled to ribbon system reference frame 81 by a set of lower pantograph pivots 152A and 152B. A left pantograph center pivot 147 is held against a left sliding bracket 156 by a left pantograph center pivot clip 149. Similarly, a right pantograph center pivot 148 is held against a right sliding bracket 157 by a right pantograph center pivot clip 150. Left sliding bracket 156 is held to ribbon system reference frame 81 by a left sliding bracket retainer 176, and right sliding bracket 157 is similarly held by a right sliding bracket retainer 177. A ribbon lift screw 175 is held to ribbon system reference frame 81 by a left end bracket 184 and a right end bracket 185 in a manner which minimizes end play. Left sliding bracket 156 contains a left lift screw engagement 186 engaged with ribbon lift screw 175, and right sliding bracket 157 contains a right lift screw engagement 187 engaged with ribbon lift screw 175. When a ribbon lift female spline 131 is rotated by engagement with ribbon lift motor male spline 130 so as to coupled to the clockwise rotation of ribbon lift motor 129, left sliding bracket 156 moves to the right and right sliding bracket 157 moves to the left, thereby lowering ribbon system lift frame 80 so that the ribbon strike band which is in use changes from ribbon strike band 21 number 2, noted hereinabove, illustratively to ribbon strike band 21 number 3.

A programmer cam card 171 is attached to left sliding bracket 156 so that both move laterally when ribbon lift screw 175 is rotated. A programmer roller 170 which is held by a programmer pantograph assembly 168 moves vertically along the top contours of programmer cam card 171. Programmer roller 170 is biased downward by a programmer spring 166 which is held by a programmer spring bracket 167 on a center bracket 158.

For embodiments of the invention where ribbon 20 is divided into six ribbon strike bands 21, programmer cam card 171 is provided with six contour positions which are arranged alternately upwards and downwards. As programmer roller 170 moves vertically, a programmer pantograph take-over link 169 also moves vertically through pivot pins to move a toggle bar 159 vertically. For ribbon strike band 21 number 2, the upwards position of programmer roller 170 pushes upwards on the left end of toggle bar 159 so as to pivot the toggle bar about a toggle bar pivot 160. The operation of such a pivoting toggle bar shall be explained hereinbelow with respect to FIG. 5. The vertical motion of ribbon system lift frame 80 is measured by a lift frame potentiometer 179 which is attached to a right mounting bracket 188 above ribbon system reference frame 81. The movable electrode of lift frame potentiometer 179 is moved by a lift frame arm 178 such that when a suitable voltage is placed across terminals 1 and 3 of lift frame potentiometer 179, a voltage proportional to the vertical position of ribbon system lift frame 80 is obtained at terminal number 2.

Figure 4B:
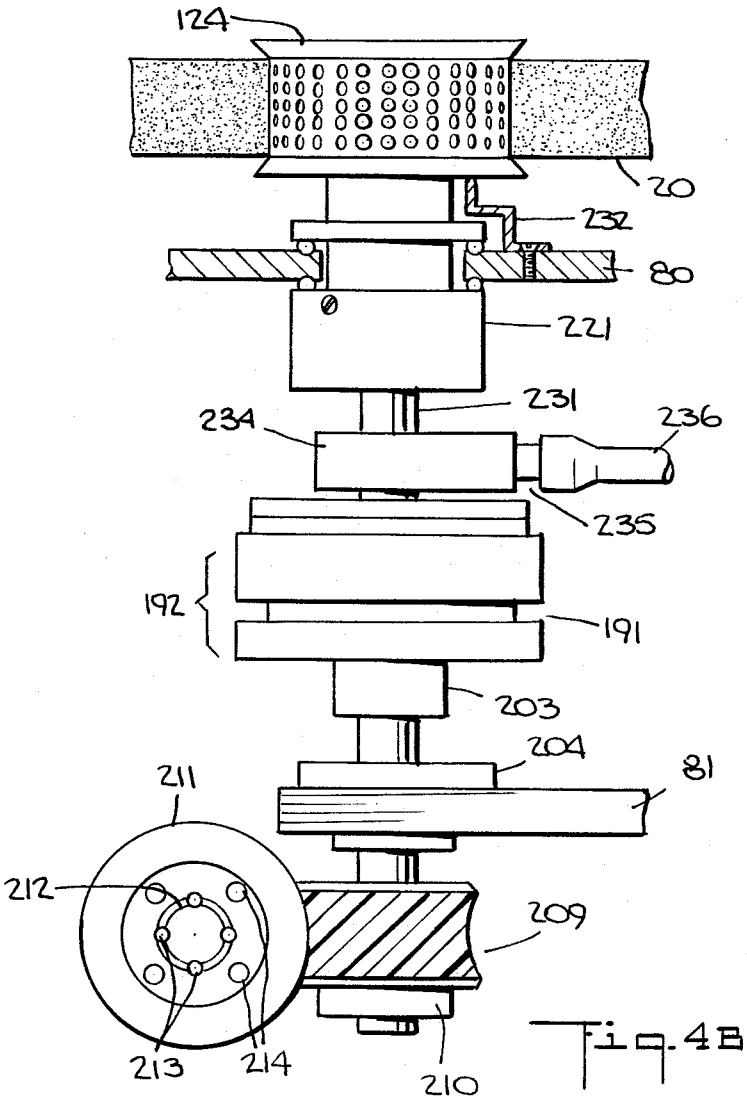
FIGS. 4A and 4B are side plan and cross-sectional views of a print hub clutch assembly.
Figure 4A:
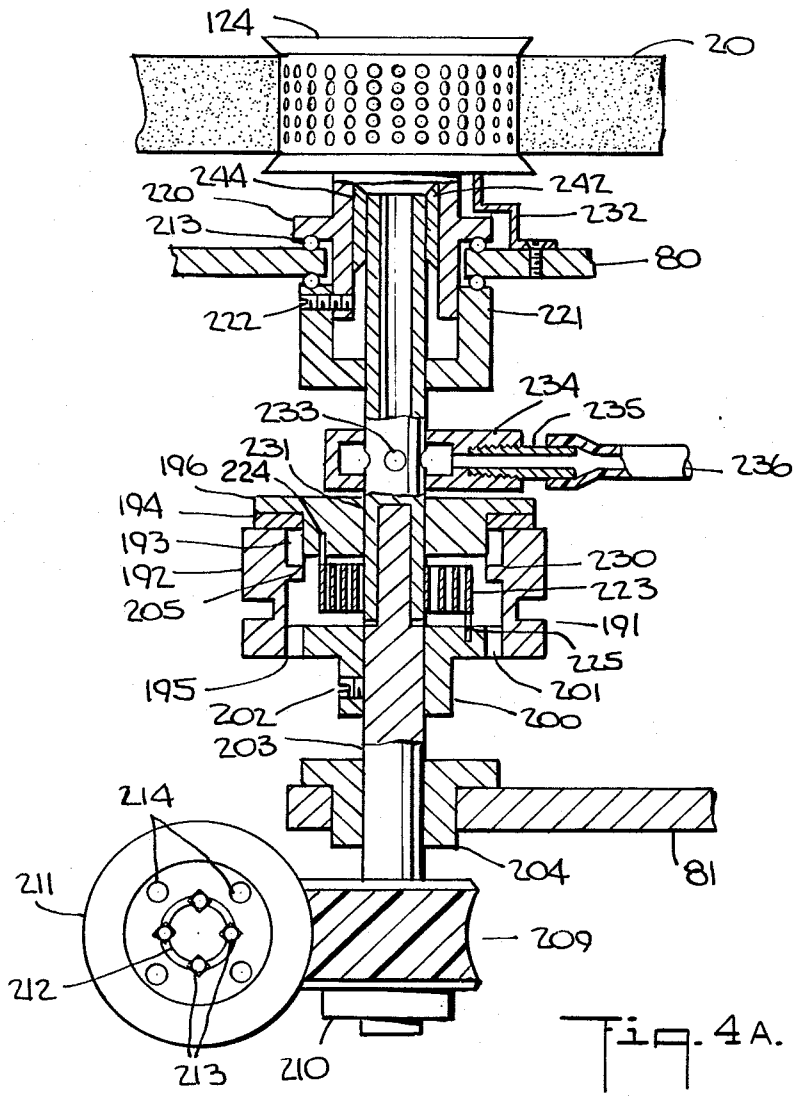

FIGS. 4A and 4B illustrate external and cross-sectional representations of a print hub clutch assembly, illustratively for driving left print drive hub 124. Each of these figures is a side view, and therefore a ribbon spline drive shaft 212 which extends across the width of printer frame 82 and is parallel and adjacent to front cross-shaft 31 (not shown in this figure, see FIG. 1) is shown in cross section. With an appropriate choice of linear bearings, ribbon spline drive shaft 212 can replace front cross-shaft 31 shown in FIG. 1.

In accordance with FIGS. 4A and 4B, a set of ball bearings 213 is concentrically interposed between ribbon spline drive shaft 212 and spline apple-core gear 211 which in turn drives a mating clutch apple-core gear 209. Mating clutch apple-core gear 209 is fastened to the base of a bottom clutch shaft 203 by a clutch gear set screw 210. Bottom clutch shaft 203 is rotatably held in ribbon system reference frame 81 by a bottom clutch shaft bearing 204. A clutch base 200 is affixed to bottom clutch 203 by a clutch base set screw 202 shown in FIG. 4A.

Clutch base 200 has a ring of clutch base teeth 201 distributed about its periphery so as to engage with a ring of clutch shell lower teeth 195 on the lower inside of a bypass clutch shell 192. When bypass clutch shell 192 is in a upper position, a ring of clutch shell upper teeth 193 engage with a ring of upper clutch hub teeth 205 on an upper clutch hub 196. An annular spring 223 is placed about an upper clutch shaft 231 which is axially bored to receive a pin formed from the uppermost portion of bottom clutch shaft 203. Upper clutch shafts 231 can therefore rotate freely on the upper pin surface of bottom clutch shaft 203. Annular spring 223 is fastened to upper clutch hub 196 by an upper annular spring pin 224, and to clutch base 200 by a lower annular spring pin 225. If bypass clutch shell 192 is in the lower position, so that a clutch shell ledge 230 rests against the periphery of clutch base 200, annular spring 223 acts to connect bottom clutch shaft 203 carrying rotation from the apple-core gear set with upper clutch hub 196 which is in turn fastened to upper clutch shaft 231. With the bypass clutch inoperative, annular spring 223 conveys rotation through upper clutch shaft 231 to left print drive hub 124 so as to drive ribbon 20. Although the annular spring may provide some frictional damping in the otherwise springy rotational connection of the two shafts, it may be advisable in some embodiments to add a very viscous agent to an elastic oil-tight bag (not shown) which fills the interior cavity surrounding the spring. Such a viscous agent may be a silicone oil with a viscosity on the order of S.A.E. 230.

A vacuum inlet body 234 is placed around a hollowed-out upper portion of upper clutch shaft 231 which is provided with a plurality of upper shaft vacuum ports 233 to admit vacuum from the vacuum inlet body to the hollowed interior of upper clutch shafts 231. By this arrangement, vacuum passes up through the hollow interior to supply the vacuum ports on left print drive hub 124. A vacuum shroud support bracket 232 is provided on ribbon system lift frame 80 to provide vacuum masking for a portion of the periphery of left print drive hub 124. Thus, the vacuum which is introduced from vacuum inlet body 234 is not distributed over the entire periphery of left print drive hub 124, but rather is provided over a predetermined segment of the periphery where contact is made with ribbon 20.

In order to allow ribbon system lift frame 80 to move vertically without inhibiting the conveyance of rotation from upper clutch shaft 231, or interfering with the passage of vacuum, upper clutch shaft 231 is provided with a plurality of upper clutch shaft splines 242 which engage with a set of lift frame bearing hub splines 241.

Figure 5:
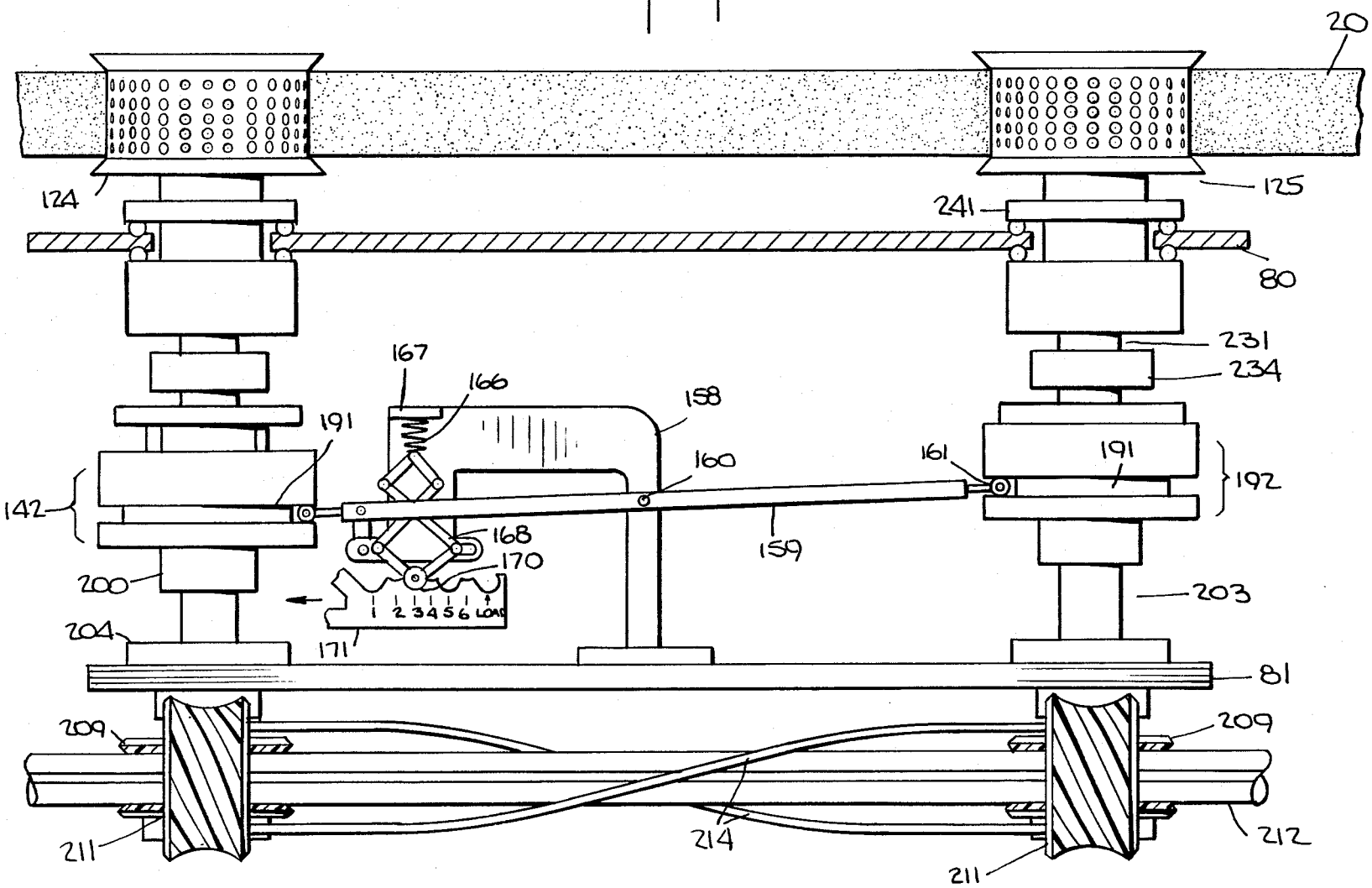
FIG. 5 illustrates the operation of a toggle bar for controlling the states of the print hub clutch assemblies.

FIG. 5 is a simplified plan view showing the interrelationship between the print hub clutches and the toggle bar. In FIG. 5, both left and right print hub clutch assemblies are shown in a rearward view, and toggle bar 159 assumes one of two positions determined by the interaction between programmer cam card 171 and programmer roller 170. Toggle bar 159 is provided on each end thereof with a toggle bar operator tip 161 which presses vertically on toggle bar operator grooves 191 in left and right bypass clutch shells 192 to activate annular spring 233 in one of the two clutch assemblies. In addition, this frontal view shows the operation of a plurality of torsion wires 214 acting between left and right spline apple-core gears 211 which are coupled via ball bearings 213 (shown in FIGS. 4A and 4B) to ribbon drive spline shaft 212. Torsion wires 214 provide a rotational bias which tends to eliminate a rotational dead zone and improve ribbon drive accuracy.

Toggle bar 159 is shown in FIG. 5 to be urged downward at its left end by virtue of the fact that programmer roller 170 is in a lowered position, corresponding to ribbon track 3. Toggle bar operator tip 161 on the left side of the toggle bar therefore urges downwardly in its associated toggle bar operator groove 91, while the toggle bar operator tip on the right-hand side urges its corresponding toggle bar operator groove 191 upward. Thus, the bypass clutch associated with right print drive hub is closed such that the annular spring therewithin is inactive. The bypass clutch associated with left print drive hub 124, however, is open, and therefore its associated annular spring is active.

Figure 6:
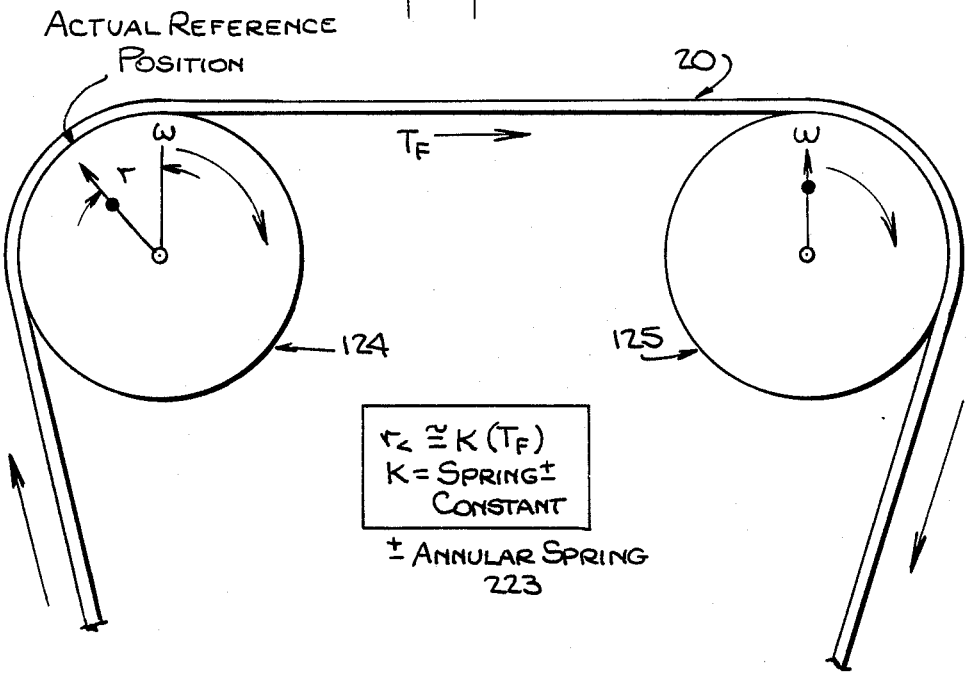
FIG. 6 is a schematic representation illustrating the ribbon tensioning system.

FIG. 6 is a schematic representation illustrating the ribbon tensioning action in the case of the transport of ribbon 20 from left to right around left print drive hub 124 and subsequently around right print drive hub 125. Bypass clutch shell 192 below left print drive hub 124 is open so that annular spring 223 acts to allow location of left print drive hub 124 to lag angularly the rotation of right print hub 125 by r degrees. Such a rotational lag creates a desirable tension in ribbon 20 between left print drive hub 124 and right print drive hub 125. Referring for the moment to FIG. 4, this rotation lag can be set by loosening clutch base set screw 202 and rotating clutch base 200 about bottom clutch shaft 203 until the desired ribbon tension is obtained, and the clutch base set screw is then retightened. The angular lag r degrees is approximately equal to the spring constant k for annular spring 223, multiplied by the tensioning force $T_f$. It should be noted, however, that the addition of a viscous or frictional damping substance in annular spring 223 makes the analysis somewhat more complex.

Figure 7:
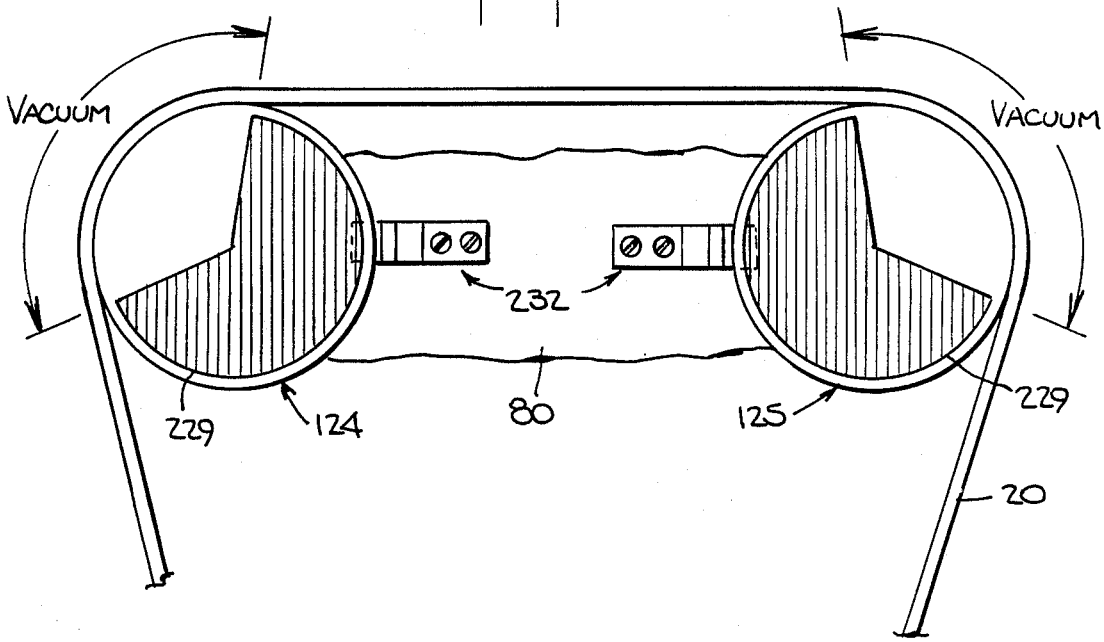
FIG. 7 is a schematic diagram illustrating vacuum shrouding within a pair of print hubs.

FIG. 7 illustrates the vacuum shrouding action in the left and right print drive hubs 124 and 125. A vacuum shroud 229 is arranged in each of the left and right print drive hubs and supported by a vacuum shroud support bracket 232 which is fastened to ribbon system lift frame 80. The vacuum shroud 229 functions to mask the vacuum within the interior of the print hub from reaching the occluded portions which are shown shaded in the left and right print hubs. The remaining periphery is active in producing a vacuum gripping action on ribbon 20.

Figure 8A:
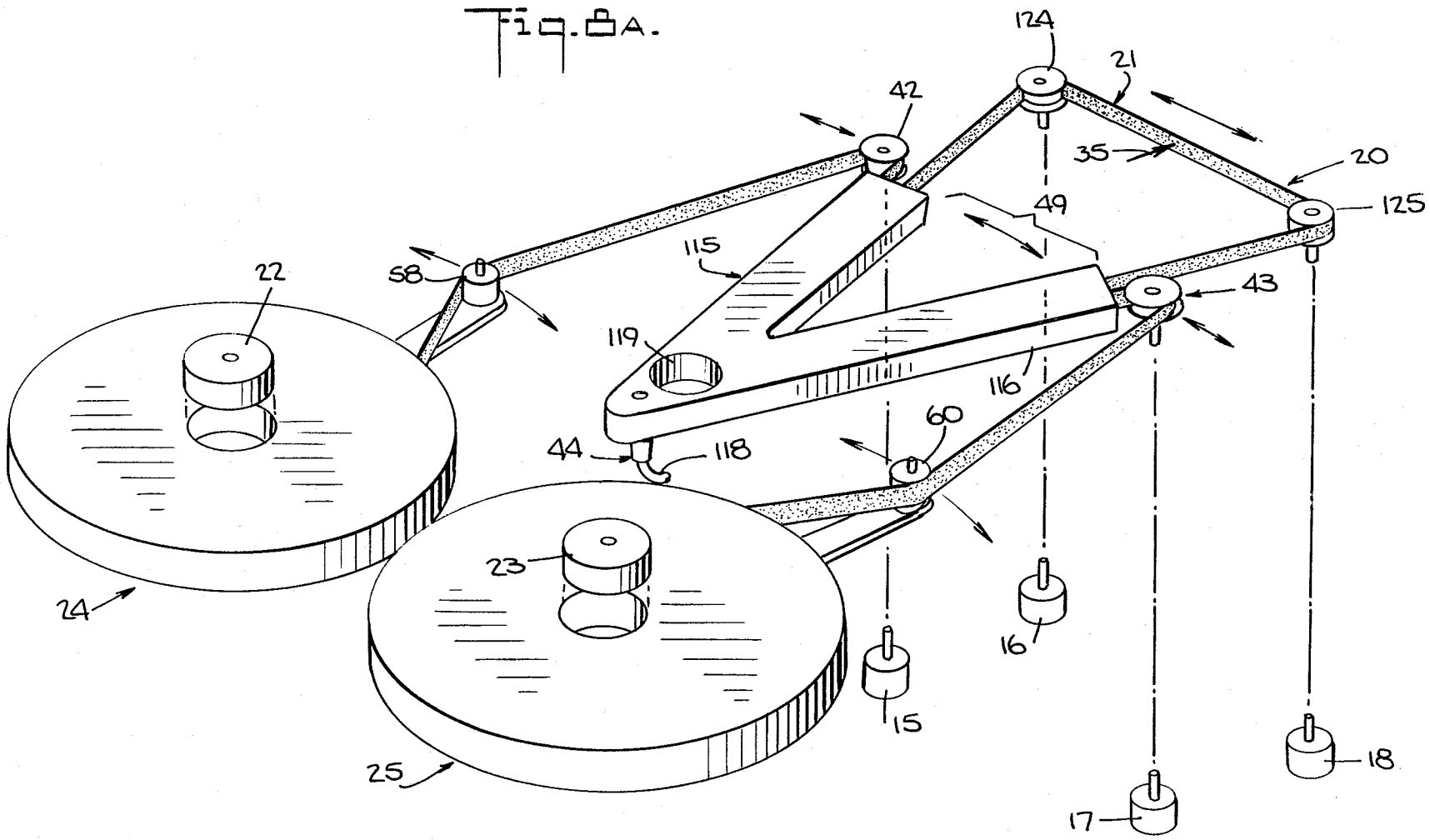
FIG. 8A is an isometric representation of a basic vacuum buffer system.

FIG. 8A is a simplified isometric, diagrammatical representation of a vacuum buffer system which is useful as a precursor for elaborating details in the following descriptions. As in FIG. 1, left ribbon reel 24 and right ribbon reel 25 act as supply and take-up reels, which function is alternated corresponding to the particular ribbon strike band 21 which is in use. Left and right vacuum columns 115 and 116 isolate ribbon 20 at print point 35 as controlled by left and right print drive hubs 124 and 125 so that very high accelerations of ribbon 20 at print point 35 may be achieved. Since main vacuum buffer case 49 must pivot about main buffer case pivot 44 as print carriage 40 moves laterally, the left and right vacuum columns are elongatable so as to compensate for the change in distance between pivot and print drive hub 124 and 125, as well as the instantaneous accelerations of ribbon 20 at print point 35.

In addition, FIG. 8A presents in a simplified representation an alternative embodiment of the invention which utilizes several separate drive motors 16, 17, and 18, rather than the single off-carriage motor drive shown in FIGS. 3, 4 and 5. Because of the very low accelerational torque required in a vacuum column ribbon transport, it may be economical for some printer designs encompassing this invention to utilize small, separate motors, wherein emplaced cost which varies with production needs and supply situations is a major determinant in the chosen design path. The use of separate motors, as shown in FIG. 8A, also facilitates presentation of the rotary function and control aspects of each unit.

The following table corresponds to a Drive Control Table which outlines each separate motor's rotative task and control inputs, for both the left-to-right flow of ribbon and the reverse, right-to-left flow, since ribbon 20 can be of a multi-level type, with, for instance, the six levels shown in FIG. 3A.

DRIVE CONTROL TABLE

CW = clockwise rotation
CCW = counterclockwise rotation
(when viewed from above in FIG. 8A)

I. Left-to-right ribbon transport: reel 24 acts as supply reel, reel 25 acts as take-up reel.

| Drive Hub | Motor acts as controlled CCW drag on |
|---|---|

-continued

| DRIVE CONTROL TABLE | |
|---|---|
| Motor 22: | reel 24 to release ribbon 20. Sensor is position of dancer 58 (sensing ribbon tension to buffer hub 42). Motor allows CW rotation. |
| Buffer Motor 15: | Rotates buffer hub 42 CW bringing ribbon 20 from dancer 58 into vacuum column 115. Sensor is photocell in vacuum column, maximum fill ⅞ths depth desired, min. fill is ⅝ths. |
| Print Drive Motor 16: | Stepper action CW to supply ribbon 20 from vacuum column 115 as needed to supply fresh ribbon at print point 35. Ribbon step follows print hammer completion, and lags print drive motor 18 step CW so as to cause slight tension in ribbon 20 at print point 35. |
| Print Drive Motor 18: | Stepper action CW to pull ribbon 20 from print point 35 and into vacuum column 116, with stepper action CW leading print drive motor 16 steps so as to cause slight tension in ribbon 20 at print point 35. |
| Buffer motor 17: | Rotates buffer hub 43 CW removing ribbon 20 from vacuum column 116. Sensor is photocell in vacuum column, desired fill is ⅝ths with under-run to ⅞ths maximum. |
| Drive hub motor 23: | Motor acts as controlled CW takeup in bursts, under control of position of dancer hub 60, sensing tension of ribbon 20 in passage from buffer hub 43 to takeup reel 25. Motor rotates reel 25 CCW. |
| II. Right-to-left ribbon tansport: reel 25 acts as supply reel reel 24 acts as take-up reel | |
| Drive hub motor 23: | Motor acts as controlled CW drag on reel 25 to release ribbon 20. Sensor is position of dancer hub 60, sensing tension of ribbon 20 in passage from reel 25 to buffer hub 43. |
| Buffer motor 17: | Rotates buffer hub 43 CCW, bringing ribbon 20 from dancer hub 60 into vacuum column 116. Sensor is photocell in vacuum column, with ⅞ths fill desired, ⅝ths minimum full. |
| Print Drive Motor 18: | Stepper action CCW to supply ribbon 20 from vacuum column 116 as needed to supply fresh ribbon at print point 35. Ribbon step follows print hammer completion, and lags print drive motor 18 step so as to cause slight tension in ribbon 20 at print point 35. |
| Print Drive motor 16: | Stepper action CW to pull ribbon 20 from print point 35 and into vacuum column 115, with stepper action leading print drive motor 18 step so as to cause slight tension in ribbon 20 at print point 35. |
| Buffer motor 15: | Rotate buffer hub 42 CW, removing ribbon 20 from vacuum column 115. Sensor is photocell in vacuum column, with desired fill kept at ⅝ths, with under-run maximum of ⅞ths fill. |
| Drive Hub motor 22: | Motor acts as controlled CW takeup in bursts, under control of position of dancer hub 58, sensing tension of ribbon 20 in passage from buffer hub 42 onto takeup reel 24. |

Note:
Print drive motors 16 and 17 are herein separate motors, as an alternative to single drive motor located off the print carriage as shown in FIGS. 3, 4, and 5. The motor sequence is the same as described above, but the clutch and retarder mechanisms provide the sequenced action using only one drive input.

Figure 8B:
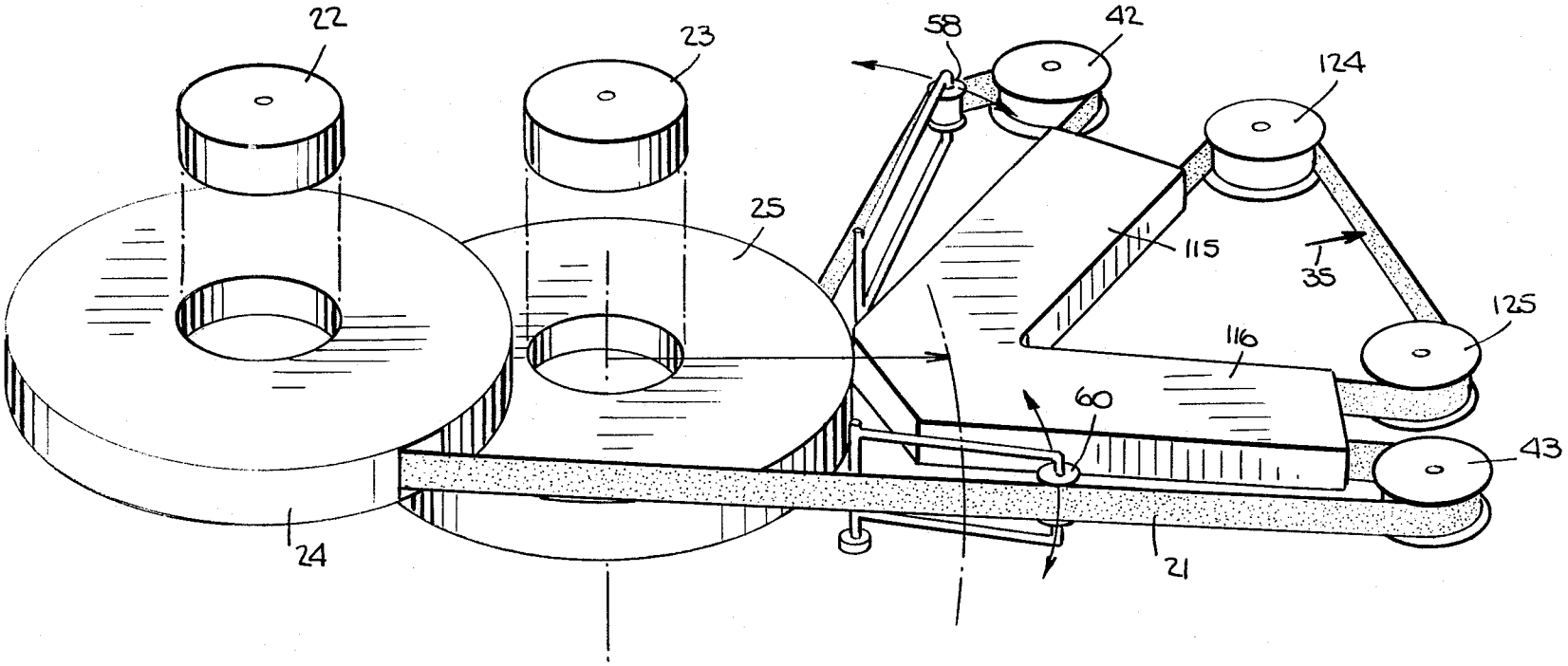
FIGS. 8B and 8C are isometric representations of multilevel ribbon reel mountings which pivot during carriage translation.

In one advantageous embodiment of the invention, shown in the diagrammatic isometric representation of FIG. 8B, ribbon reels 24, 25 are arranged on respective planes such that reel 24 is above reel 25. Such a stacked arrangement permits the ribbon reels to have large diameters without increasing the cabinet size of the printer. The center shaft of hub motor 22 which drives reel 24 is located so as to clear the outer circumference of the lower reel, reel 25.

Figure 8C:
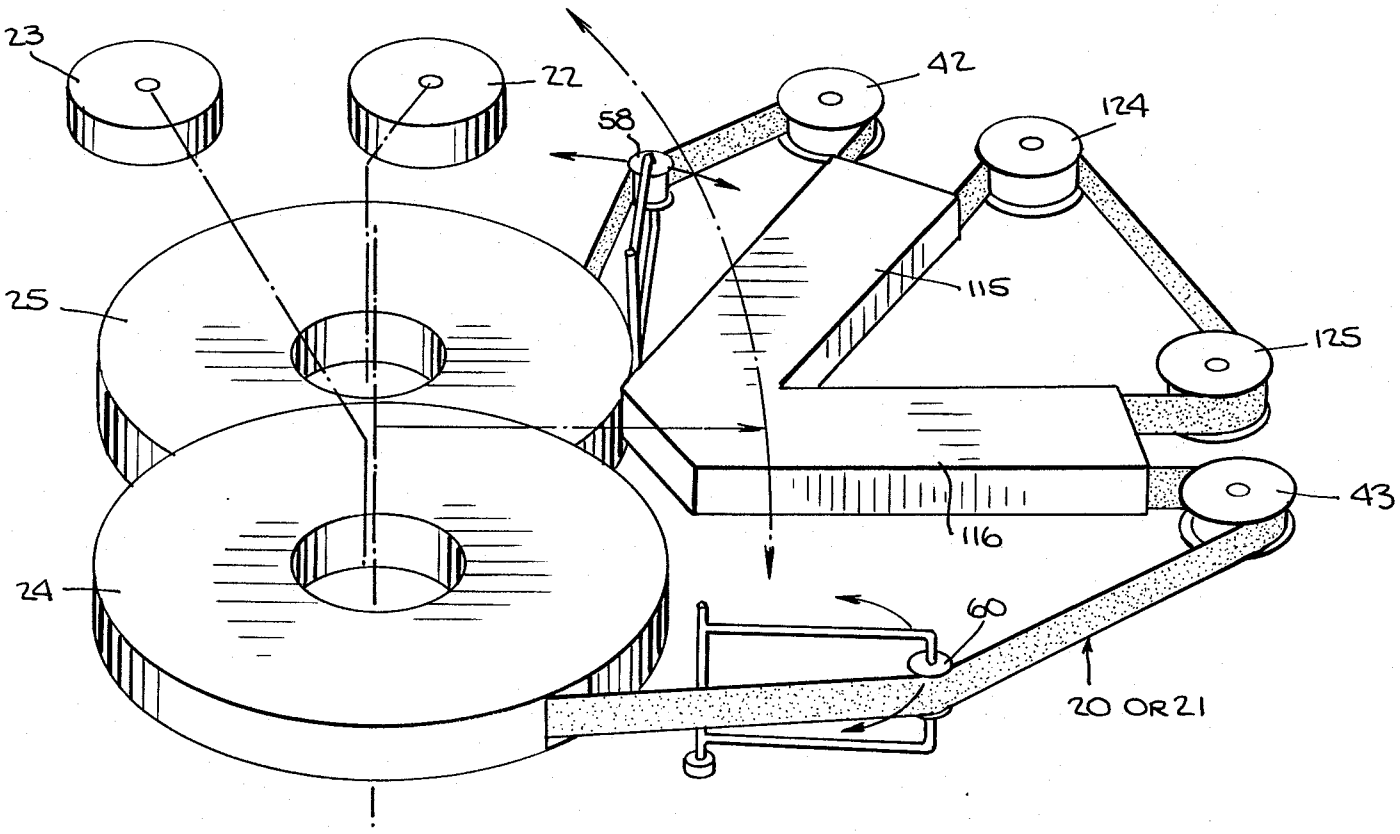

In FIG. 8C, the reel hub centers are arranged to overlap approximately one-third of the side-to-side width of the printer. Thus, each reel may have a diameter which is about two-thirds of overall printer width, yet takes less end-to-end length than does the stacked configuration of FIG. 8B which uses a longitudinal axis for reel placement.

A particularly advantageous embodiment of the invention is shown in FIG. 9B, wherein the reel centers are arranged coaxially and centered in the printer, again with all of the ribbon and reel weight borne by the printer chassis, not the moving part carriage. In any of the multiplane reel configurations, the designer is advantageously provided with the further option of canting one of the reels, the vacuum changer, or a dancer hub. For best space utilization, the choice illustrated in FIGS. 8B, 8C or 9B is that of canting the dancer hub 60 and its associated pivot harness. Once a canted dancer hub 60 is employed, single level ribbon 20 or multiheight ribbon 21 flows from the supply reel to the takeup reel, in the manner described hereinbefore.

Figure 9A:
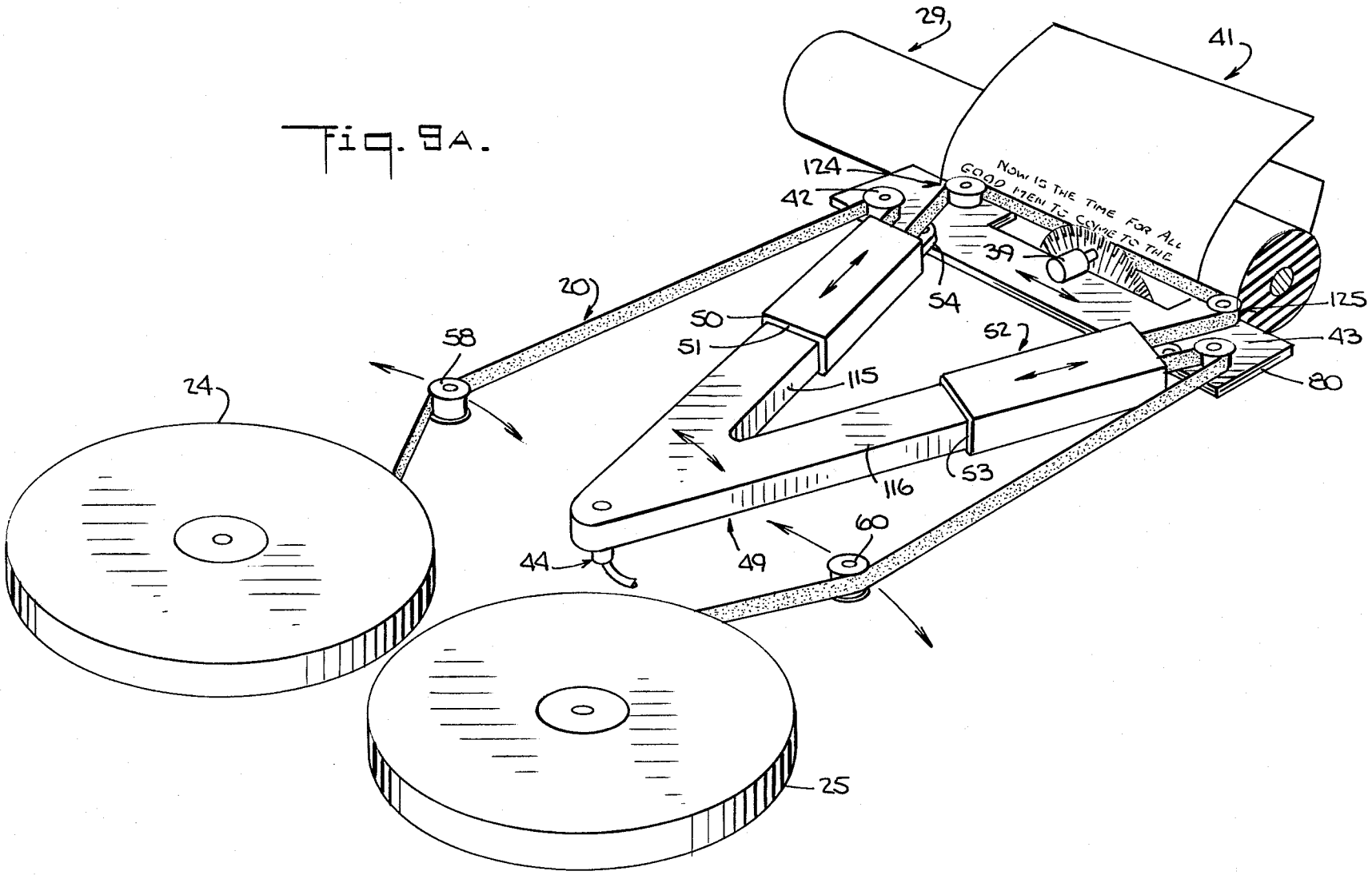
FIG. 9A is an isometric representation of a portion of a buffer system having a slidable extension.

FIG. 9A illustrates structure corresponding to a portion of the embodiment shown in FIG. 8, and illustrates the details of the vacuum column extensions in the form of a left sliding buffer case 50, which is essentially identical to a right sliding buffer case 52. A left sliding buffer seal 51 (not shown in detail) is interposed between left sliding buffer case 50 and the exterior of left vacuum column 115. Similarly, as evident from FIG. 8A, right sliding buffer case 52 is provided with a right sliding buffer seal 53 (not shown) for preventing vacuum leaks around the exterior of right vacuum column 116. The left and right sliding buffer cases are pivoted on ribbon system lift frame 80 by a pair of sliding case pivots 54. As ribbon system lift frame 80 traverses laterally, the distance between main buffer case pivot 44 and sliding case pivots 54 will lengthen or shorten, so that left and right sliding buffer cases 50 and 52 will slide back and forth around main vacuum buffer case 49. Left and right buffer control hubs 42 and 43 have been remounted to a position on ribbon system lift frame 80 adjacent to left and right print hubs 124 and 125. This arrangement wherein buffer control hubs 42 and 43 are mounted near the mouth of the vacuum columns assists in feeding the ribbon in and out of the vacuum columns. As will be described hereinbelow with respect to FIG. 16, additional mechanisms may be provided for ensuring that the ribbon is initially properly loaded into the vacuum columns.

Figures 10A, 10B, 10C:
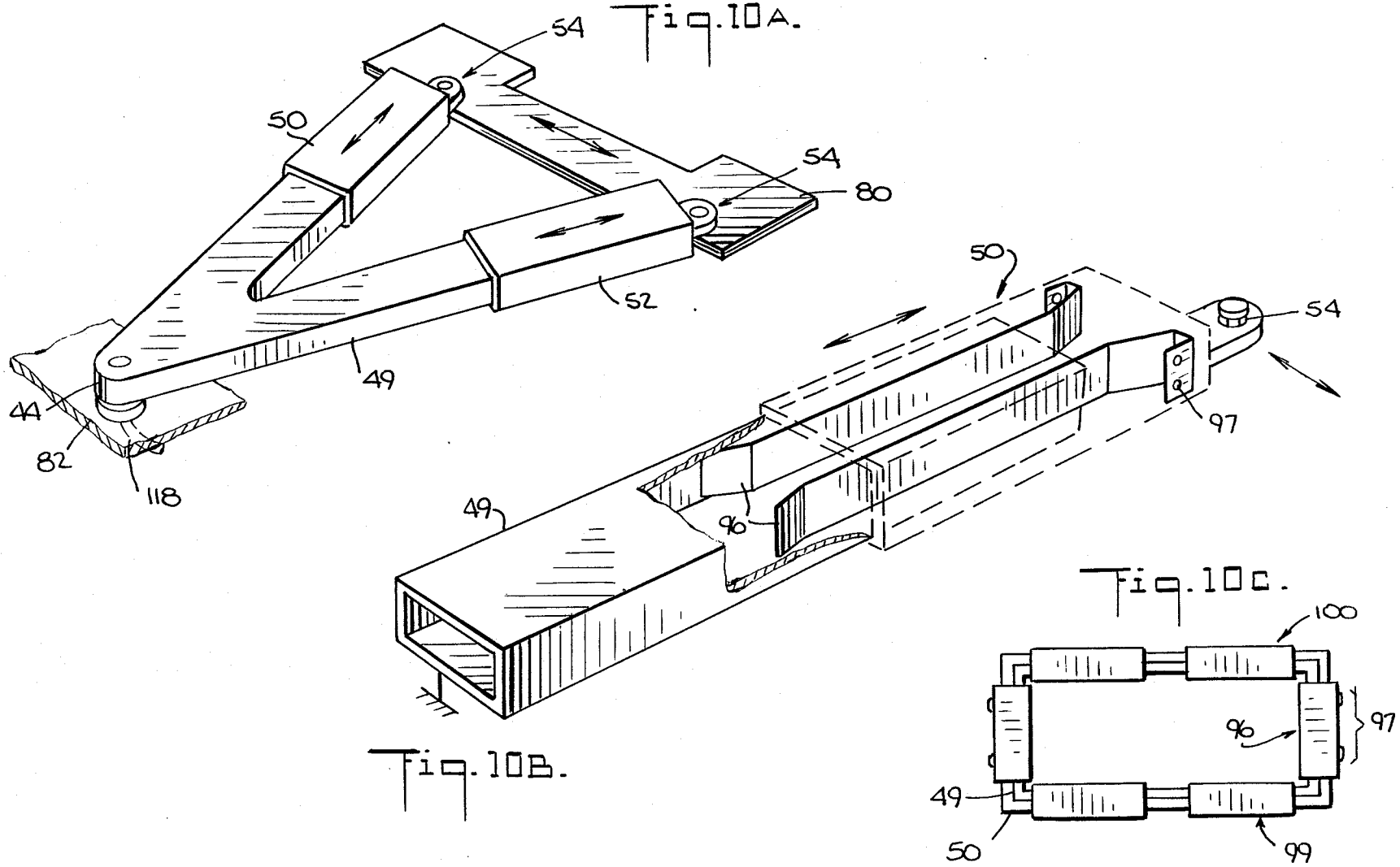
FIGS. 10A, 10B and 10C illustrate selected mechanical details of the embodiment shown in FIGS. 9A and 9B.

FIGS. 10A, 10B, and 10C show selected details of the vacuum columns with their respective sliding buffer cases and buffer seals, and an antifriction system. FIG. 10A shows left and right sliding buffer cases 50 and 52 which are slidably sealed to main vacuum buffer case 49. Ribbon 20, as it enters and exits each vacuum column, must slide over an edge at the joint between main buffer vacuum case 49 and the over-sliding buffer cases, resulting in possible scraping of, and damage to, the ribbon. This problem is alleviated by the arrangement shown in FIG. 10B which is provided with a set of sliding side adaptor plates 96 which are added to the interior of the vacuum column. The spring tips of sliding side adaptor plates 96 are arranged over the interface between the main vacuum buffer case and the sliding buffer case so as to provide a smooth surface over which the ribbon is contacted. Moreover, such sliding side adaptor plates assist in vacuum sealing. In one embodiment, the sliding side adaptor plates may be coated with a low friction surface material, such as Teflon S composite (a trademark of DuPont). A plurality of adaptor plate clips 97 are provided to secure the sliding side adaptor plates to the sliding buffer case. In accordance with a further embodiment of the invention shown in the partially fragmented depiction of FIG. 10C, the edge which is produced on the top and bottom surfaces where the main vacuum buffer case meets with the sliding buffer cases can be corrected by bottom and top sliding adaptor plate 99 and 100. Bottom and top sliding adaptor plates 99 and 100 prevent shredding of the edges of the ribbon.

Although the invention has been described in terms of specific embodiments and applications, persons skilled in the art, in light of this teaching, can generate additional embodiments without exceeding the scope or departing from the spirit of the claimed invention. Accordingly, it is to be understood that the drawings and descriptions in this disclosure are proffered to facilitate comprehension of the invention and should not be construed to limit the scope thereof.

What is claimed is:

1. In a printer comprising a chassis, a paper support platen mounted on said chassis, a printing carriage for mounting impact printer means, means mounting said printing carriage for translation with respect to said chassis and said paper support platen, ribbon transport system means having a ribbon supply means for a print ribbon and a ribbon take-up means, said ribbon transport system means defining a predetermined ribbon utilization path parallel to the translation of said print carriage with respect to said paper support platen, with said ribbon utilization path being located between said ribbon supply means and said ribbon take-up means and being for use by the impact printer means, the improvement comprising:

vacuum storage chamber means for storing said print ribbon between said ribbon supply means and said ribbon utilization path and between said ribbon utilization path and said ribbon take-up means; and means for mounting at least a portion of said vacuum storage chamber means for angular displacement with respect to said chassis responsive to translation of said printing carriage with respect to said chassis.

2. A printer according to claim 1 further comprising:

means to couple said vacuum storage means to said printing carriage; and means to pivotally mount said vacuum storage means with respect to said chassis.

3. A printer according to claim 1 wherein said vacuum storage chamber means comprises a first vacuum storage chamber located to store ribbon between said ribbon supply means and said ribbon utilization path and a second vacuum storage chamber located to store ribbon between said ribbon utilization path and said ribbon take-up means.

4. A printer according to claim 3 wherein said first vacuum storage chamber and said second vacuum storage chamber each has the shape of a column having a longitudinal axis.

5. A printer according to claim 4 wherein said column longitudinal axes have an angular relationship with respect to one another, said angular relationship being maintained substantially constant upon angular displacement of said vacuum storage chamber means responsive to translation of said printing carriage.

6. A printer according to claim 5 wherein the column of said first vacuum storage chamber and the column of said second vacuum storage chamber each has an extension means and said printer further comprises means for displacing said respective extension means longitudinally with respect to said respective longitudinal axis responsive to translation of said printing carriage thereby varying the longitudinal dimension of the associated first and second vacuum storage chambers responsive to translation of said printing carriage.

* * * * *